US007036629B2

(12) United States Patent
Nicolaysen

(10) Patent No.: US 7,036,629 B2
(45) Date of Patent: May 2, 2006

(54) STANDING SEAM ROOF BRACKET

(76) Inventor: Bruce Nicolaysen, 674 Depot Hill Rd., Poughquaq, NY (US) 12570

( * ) Notice: Subject to any disclaimer, the term of this patent is extended or adjusted under 35 U.S.C. 154(b) by 0 days.

(21) Appl. No.: 10/152,048

(22) Filed: May 22, 2002

(65) Prior Publication Data

US 2003/0217890 A1 Nov. 27, 2003

(51) Int. Cl.
*E04G 3/00* (2006.01)

(52) U.S. Cl. ..... 182/45; 248/238

(58) Field of Classification Search ..... 182/45; 248/238; 52/749.12
See application file for complete search history.

(56) References Cited

U.S. PATENT DOCUMENTS

| | | | | |
|---|---|---|---|---|
| 330,971 | A | 11/1885 | Elmer | |
| 789,640 | A * | 5/1905 | Wainwright | 182/45 |
| 1,054,091 | A | 2/1913 | Darnall | |
| 1,365,996 | A * | 1/1921 | Herwick | 182/45 |
| 1,569,951 | A | 1/1926 | Cooper | |
| 1,770,097 | A * | 7/1930 | Bebe | 248/237 |
| 2,275,014 | A * | 3/1942 | Hahler | 248/237 |
| 3,058,542 | A * | 10/1962 | Rogalla | 182/45 |
| 3,164,353 | A | 1/1965 | Rene | 248/237 |
| 3,526,296 | A | 9/1970 | Stevens | 182/45 |
| 4,060,944 | A | 12/1977 | Sandring | 52/43 |
| 4,334,662 | A | 6/1982 | Davis et al. | 248/237 |
| 4,442,581 | A | 4/1984 | Molnick | 29/243.5 |
| 5,249,769 | A | 10/1993 | Griek et al. | 248/225.31 |
| 5,474,271 | A * | 12/1995 | Raymond | 248/237 |
| 5,694,720 | A | 12/1997 | Walcher et al. | 51/111 |
| 5,758,743 | A | 6/1998 | Coyle et al. | 182/45 |

FOREIGN PATENT DOCUMENTS

| | | |
|---|---|---|
| DE | 24 48 136 A1 | 4/1976 |
| DE | 85 17 449 U | 8/1985 |
| DE | 93 00 539 U | 3/1993 |
| EP | 0 952 272 A1 | 10/1999 |
| FR | 816242 A | 8/1937 |
| FR | 1275506 A | 11/1961 |

* cited by examiner

*Primary Examiner*—Alvin Chin-Shue
(74) *Attorney, Agent, or Firm*—Fitzpatrick, Cella, Harper & Scinto

(57) ABSTRACT

A roof attachment apparatus for being mounted on a roof having at least one standing seam. The apparatus comprises a plurality of base plates for being disposed on opposite sides of the standing seam on a surface of the roof, a platform support member for supporting at least one scaffolding plank, and plural support bars. The support bars are orientated so as to enable a downward force applied to the platform support member (e.g., as a result of the weight of plank(s) and/or a worker) and transferred to the support bars to be directionally distributed to the first and second base plates in a manner which causes those base plates to displace towards one another and clamp the standing seam. In this manner, the apparatus is maintained in a stationary position for supporting scaffolding planks on the roof, regardless of the roof pitch.

13 Claims, 8 Drawing Sheets

STANDING SEAM ROOF BRACKET

BACKGROUND OF THE INVENTION

1. Field of the Invention

This invention relates generally to safety devices for use in, for example, the construction industry, and, in particular, to a scaffold supporting standing seam roof bracket which is adjustable for use on roofs having a wide range of pitches.

2. Related Background Art

In the construction and repair of buildings, builders often must work on inclined roof decks. One known type of roof deck has roof panels that fit together at standing seams. The standing seams typically extend across the roof, and interlock and secure the panels together. Although standing seam roofs provide many benefits, they generally do not provide a convenient means for enabling workers to support themselves and prevent against falling from the roof. In order to overcome this problem, various mechanisms have been employed. One known mechanism is a hook and safety line assembly that attaches at one end of the line to a safety belt worn by a worker and engages through the hook with a suitable roof edge, such as a ridge of the roof, at the other end of the line.

U.S. Pat. No. 5,694,720 discloses a safety clamp that attaches to standing seams of a roof deck. The safety clamp attaches to the standing roof seams by moving a threaded member to hold three standing seams in clamped relation between movable tabs of the clamp. A safety line attached to both the safety clamp and a worker's safety belt supports the worker to prevent him from falling from the roof deck.

U.S. Pat. No. 5,758,743 discloses a personal safety lanyard roof attachment apparatus that includes a top bar having a coupling adapted for retaining a personal safety lanyard, a pair of end supports each pivotally connected to the top bar at opposite ends thereof, a pair of crossbars interconnecting the pair of end supports, and a pair of clamping members secured to each pair of crossbars. The clamping members each comprise an adjustable clamp including a clamping handle for clamping a pair of clamping jaws, and the clamping handle includes a lock ring for locking the clamping handle in a clamped position.

U.S. Pat. No. 5,249,769 discloses a support which clamps to a raised profile of roof decking and supports a safety barrier or a display sign. The support comprises a clamp and a support element over which an upright support post carrying the barrier is telescopically received. The clamp comprises a pair of clamping jaws which are pivoted to each other and have respective feet at their ends remote from the pivotal connection. The feet engage the deck and have projecting flanges which cooperate with opposed undercuts on the raised profile when the clamp is tightened by a screw threaded arrangement remote from the pivotal connection. A brace is provided with a clamp similar to the above-described clamp. The brace is rotatable about the support element and the clamp can be correspondingly adjusted to be clampable to the same or different profile as the clamp.

U.S. Pat. No. 4,334,662 relates to a device for supporting a load on a standing seam roof. A platform is provided for spanning the distance between two adjacent roof seams and camming means are mounted on opposite sides of the platform for engaging parallel roof seams.

U.S. Pat. No. 3,164,353 relates to a variable pitch roof bracket that includes an elongated rod forming a base or backbone and being adapted for securement to a roof structure. A platform arm is pivotally mounted to an upper end of a base member, and a locking cam positioner is slidably movable on the base member. A rigid pivotally mounted linkage interconnecting the platform arm and cam effects a locking of the cam upon a slight downward movement of the platform arm.

While some of the above-described mechanisms may be generally good for their intended applications, they suffer from a number of drawbacks. For example, many of the prior art mechanisms scratch, puncture, or otherwise physically damage roof structures when mechanically attached thereto. Moreover, some of the above-described prior art mechanisms have complex structures and are heavy in weight, thereby making them unwieldy to handle and arrange on roof decks.

There therefore exists a need for an improved standing seam roof bracket for supporting scaffolding, and which is light-weight, easy to transport and arrange on a standing seam rook deck, and adjustable for use on roofs having a wide range of pitches.

SUMMARY OF THE INVENTION

It is an object of this invention to provide a roof bracket that can be attached to a standing seam roof, and which supports scaffolding.

It is another object of this invention to provide a scaffold-supporting roof bracket that can be easily and readily installed and removed on a roof deck.

It is another object of this invention to provide a light-weight and easily transportable roof bracket for supporting scaffolding on a roof deck.

It is a further object of this invention to provide a standing seam roof bracket for supporting scaffolding, and which is adjustable for use on roof decks having a wide range of pitches.

Further objects and advantages of this invention will become apparent from a consideration of the drawings and ensuing description.

The above-described problems are overcome and the foregoing objects of the invention are realized by a roof attachment apparatus (also referred to herein as a "roof bracket") for being mounted on a building roof having at least one standing seam. In accordance with a preferred embodiment of the invention, the apparatus comprises a plurality of base plates, such as a first base plate and a second base plate, wherein the first base plate is for being disposed on a surface of the roof, and the second base plate also is for being disposed on the surface of the roof, but on an opposite side of the standing seam from where the first base plate is disposed. The apparatus also comprises a platform support member for supporting one or more scaffolding planks, and a plurality of support bars. Preferably, the support bars include a plurality of first support bars and a plurality of second support bars, each first support bar has a first end pivotally secured to the platform support member and a second end pivotally secured to the first base plate, and each second support bar has a first end pivotally secured to the platform support member and a second end pivotally secured to the second base plate. The first and second support bars have an orientation such that, when a downward force (resulting from, for example, the weight of a scaffolding plank and/or a worker) is applied to the platform support member, the force is directionally distributed through the support bars to the first and second base plates in a manner which causes the first and second base plates to displace towards one another and clamp the standing seam.

In accordance with one embodiment of the invention, the roof attachment apparatus further comprises a plurality of base plate pads, each of which covers at least a portion of an outer surface (e.g., a lower surface and a side surface, for contacting the upper roof surface and standing seam, respectively) of a corresponding base plate. Preferably, the base plate pads each comprise rubber or some other non-abrasive material. The use of such a material tends to prevent the apparatus from sliding along the roof surface, and also prevents the apparatus from scratching or otherwise damaging the roof while clamped thereto. The lower surface of each base plate pad also may be ribbed to further ensure the stationary positioning of the apparatus on the upper roof surface.

Preferably, the platform support member comprises a main frame, an elongated platform support arm pivotally secured adjacent a first end thereof to a rear portion of the main frame, and being rotatable about at least part of that rear portion, and an elongated support member having a first end secured to an intermediate portion of the platform support arm, near a second end of the platform support arm. A fastener secures a selected portion (along the length) of the elongated support member, to a front portion of the main frame opposing the rear portion, for enabling the platform support arm to be fixedly inclined at a selected angle relative to the rear portion of the main frame. This capability enables the platform support arm to be positioned in an orientation which ensures that any scaffolding planks placed thereon are positioned in an appropriate orientation for ensuring worker safety, regardless of the roof pitch.

In the preferred embodiment of the invention, the main frame comprises an upper main frame portion having a predetermined (e.g., substantially rectangular) shape, an intermediate main frame portion, and a lower main frame portion, wherein the intermediate main frame portion is fixedly coupled to the upper and lower main frame portions and orientated so as to fixedly support at least part (e.g., a rear portion) of the upper main frame portion. Also in the preferred embodiment of the invention, at least a first one of the support bars is pivotally coupled at a first end thereof to a front portion of the upper main frame portion and at a second end thereof to a first one of the base plates, and at least a second one of said support bars is pivotally coupled at a first end thereof to the front portion of the upper main frame portion and at a second end thereof to a second one of the base plates. Moreover, at least a third one of the support bars is pivotally coupled at a first end thereof to the lower main frame portion and at a second end thereof to the first one of the base plates, and at least a fourth one of the support bars is pivotally coupled at a first end thereof to the lower main frame portion and at a second end thereof to the second one of the base plates.

Each of the first and third support bars preferably is disposed along a respective axis that forms at least one angle relative to an upper surface of the first base plate, and each of the second and fourth support bars preferably is disposed along a respective axis that forms at least one angle relative to an upper surface of the second base plate. Moreover, the second end of each support bar preferably is located closer to a plane in which the standing seam extends than the first end of that support bar, for enabling at least part of the force distributed through that support bar and applied to the corresponding base plate, to be directed towards the standing seam.

In accordance with one embodiment of the invention, the roof attachment apparatus further comprises a plurality of elongated passive support bars coupled to at least the main frame and orientated so as to further support the main frame from the base plates, at least during times when the downward force is applied to the platform support member.

Also in accordance with one embodiment of the invention, the roof attachment apparatus further comprises at least one clamping mechanism coupled to the first and second base plates. The clamping mechanism functions to further ensure the locking engagement of the first and second base plates to the standing seam, and, depending on which type of mechanism is employed, may or may not be adjustable to relatively displace the first and second base plates towards and away from each other. In one embodiment of this invention, the clamping mechanism comprises, for example, tube portions secured to the respective base plates, an elongated shaft or rod-like member which can be received in channels of the tube portions, and a washer and clip assembly for substantially securing the position of the shaft in the tube portions and thereby further ensuring the locking engagement of the base plates to the standing roof seam. In another embodiment of the invention, the shaft and tube portions are threaded for enabling the shaft's position, and hence the relative positions of the base plates, to be adjusted automatically.

Also, in accordance with one embodiment of the invention, each base plate extends in a plane that forms an angle relative to a plane in which the upper main frame portion extends, to enable the apparatus to be employed on a pitched roof, although, as described above, the adjustability of the platform support arm also enables scaffolding planks to be adequately and safely supported, regardless of the roof pitch.

Preferably, at least some of the components of the roof attachment apparatus include a light-weight material, such as, for example, aluminum, so that the overall apparatus is light-weight, and thus easy to transport and arrange on a building roof deck. The use of aluminum or another non-ferrous material is advantageous in that such materials do not rust or cause associated rust stains on roof decks.

The above set forth and other features of the invention are made more apparent in the ensuing Detailed Description of the Preferred Embodiments when read in conjunction with the attached drawings, wherein.

Figure 1:
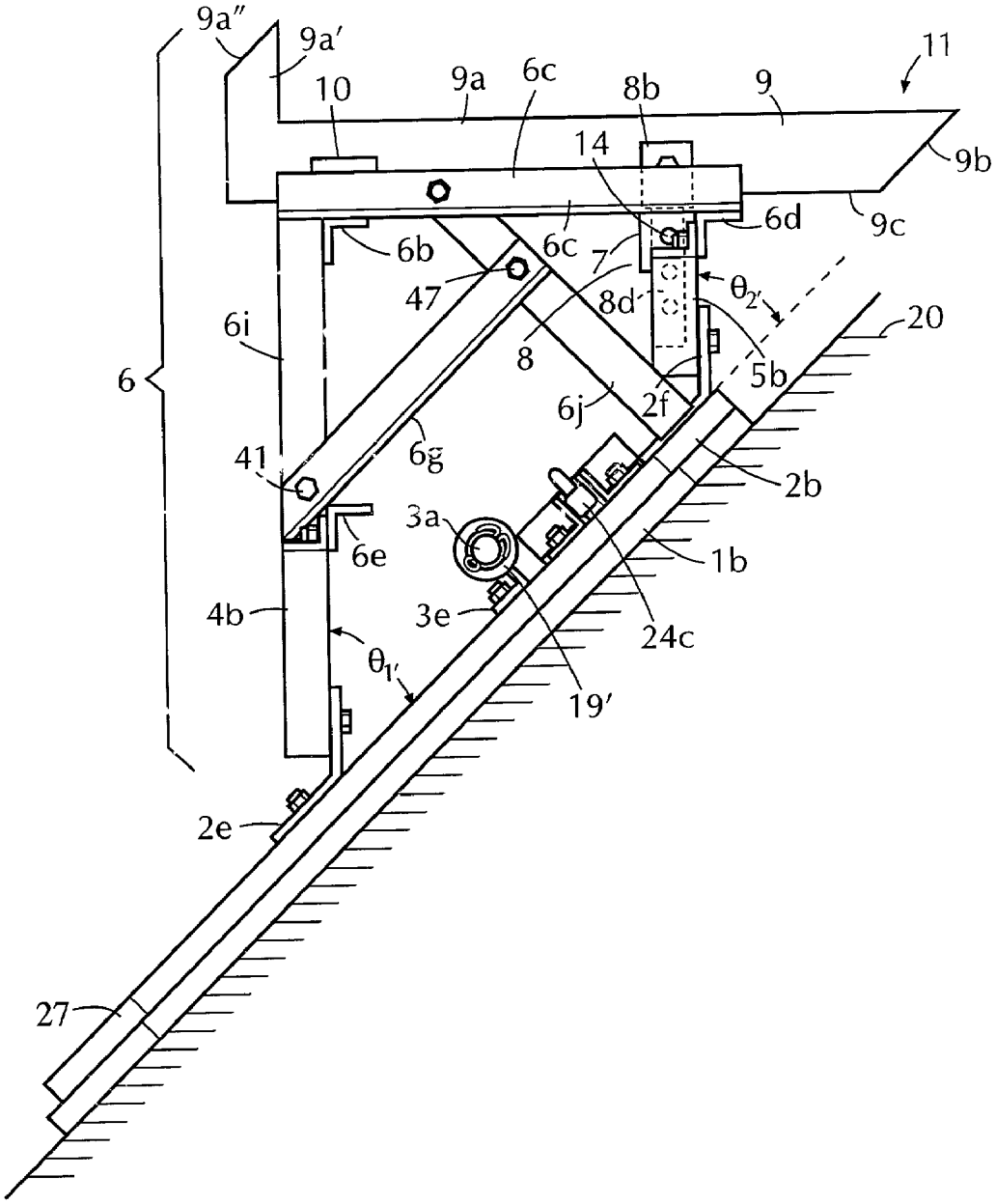
FIG. 1 shows a standing seam roof bracket constructed in accordance with this invention, as viewed from a perspective looking towards a side thereof, wherein the standing seam roof bracket is shown disposed on a standing seam roof 20.
Figure 2:
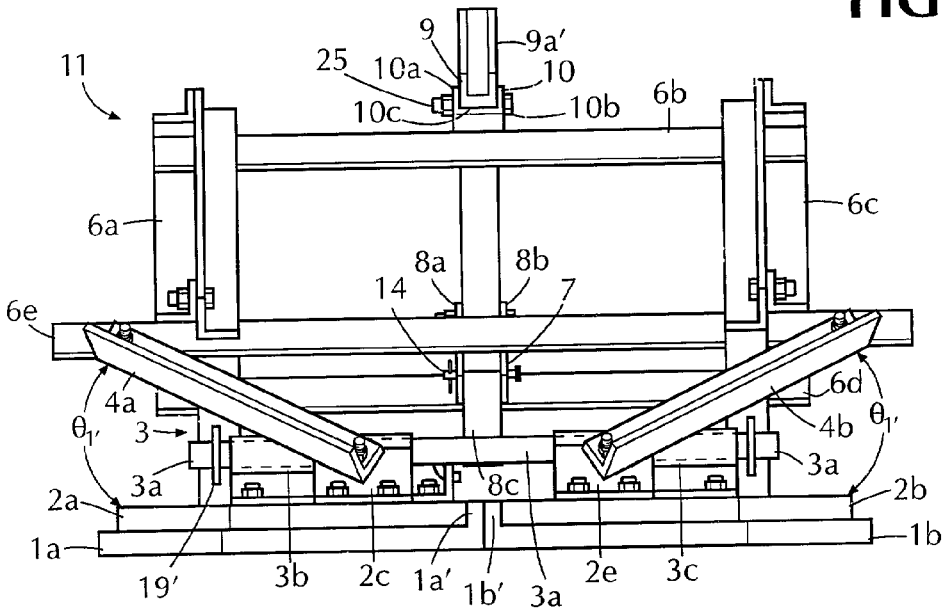
FIG. 2 shows the standing seam roof bracket of FIG. 1, as viewed from a perspective looking towards a rear of the bracket.
Figure 3:
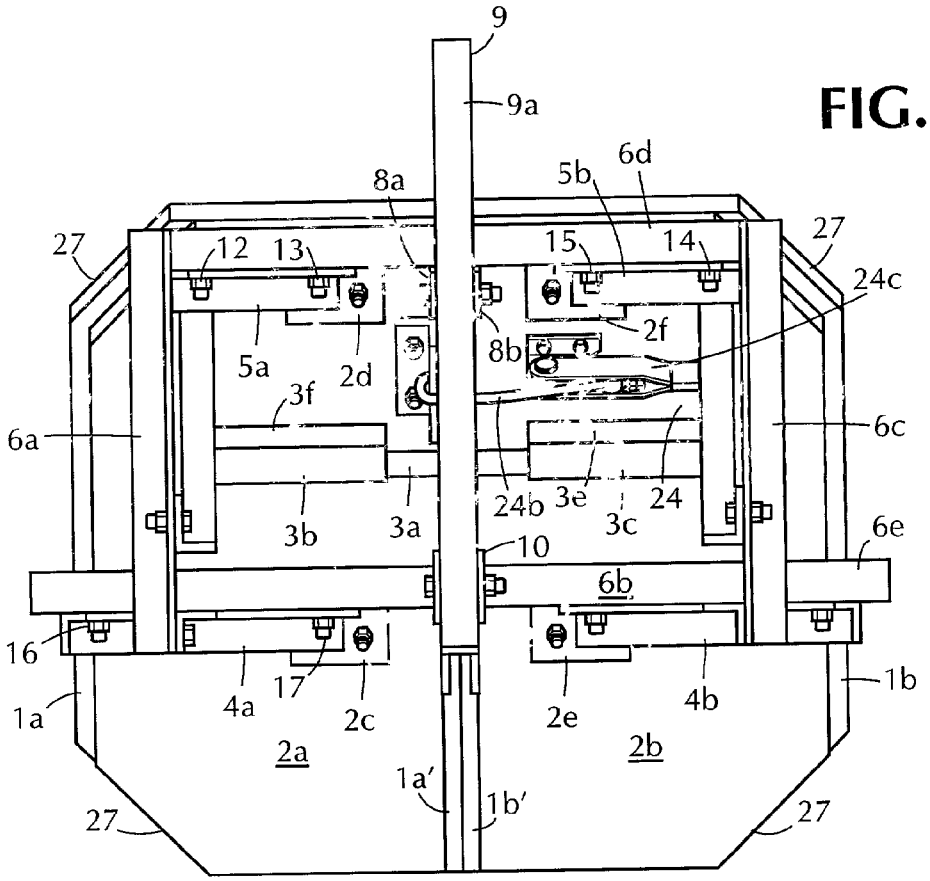
FIG. 3 shows the standing seam roof bracket of FIG. 1, as viewed from a perspective looking down on a work platform 9 of the bracket.
Figure 10:
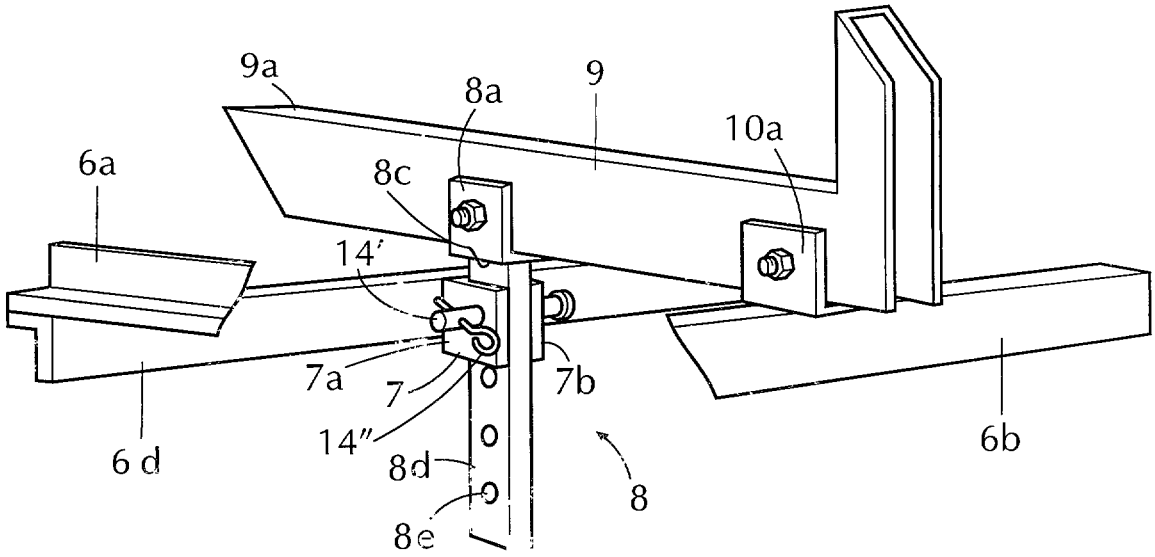

FIG. 10 is a perspective view of a front adjustment rod and pivot assembly 8, a work platform 9, and upper main frame portions 6*a*, 6*b*, and 6*d* of the standing seam roof bracket of FIG. 1.

Identical portions of the various figures have been identified with the same reference numerals in order to simplify the description of the present invention.

DETAILED DESCRIPTION OF THE PREFERRED EMBODIMENTS

Referring to FIGS. 1–8, an example of a standing seam roof bracket 11 constructed in accordance with a preferred embodiment of this invention will now be described. The illustrated roof bracket 11 comprises a platform support member that includes a main frame 6, a work platform 9, a rear pivot assembly 10, and a front adjustment rod and pivot assembly 8, and also comprises a plurality of front active support bars 5*a* and 5*b*, a plurality of rear active support bars 4*a* and 4*b*, base plates 2*a* and 2*b*, a rod and lock assembly 3, a latch/lock mechanism 24, support gussets 2*c*–2*f*, base plate pads 1*a* and 1*b*, and front passive support bars 6*j* and 6*k*. In a preferred embodiment of the invention, at least some, and preferably all (except for, e.g., pads 1*a*, 1*b* and mechanism 24), of those components of the bracket 11 comprise aluminum so that the overall bracket 11 is lightweight, although in other embodiments, any other suitable materials may be employed instead. For example, any suitable non-ferrous materials also may be employed so that the bracket 11 is not susceptible to rusting and causing undesired rust stains on a building roof deck 20 when arranged thereon.

The main frame 6 preferably comprises an upper main frame portion that includes a plurality of upper main frame portions 6*a*–6*d*, a lower main frame portion that includes at least one lower frame portion 6*e*, and an intermediate main frame portion that includes a plurality of intermediate frame portions 6*f*–6*i*, each of which portions 6*a*–6*i* includes, for example, an elongated aluminum angle (illustrated) (e.g., a 1"×1" angle), bar, or tubing. Preferably, the lower frame portion 6*e* is longer than upper frame portion 6*b*, although respective outer facing surfaces of those frame portions 6*e* and 6*b* preferably lie in substantially a same plane. A first end of frame portion 6*a* is welded or otherwise affixed to a first end of frame portion 6*d*, a first end of frame portion 6*c* is welded or otherwise affixed to a second end of frame portion 6*d*, a second end of frame portion 6*a* is welded or otherwise affixed to a first end of frame portion 6*b*, and a second end of frame portion 6*c* is welded or otherwise affixed to a second end of frame portion 6*b*. The upper main frame portions 6*a*–6*d* collectively form a substantially rectangular shape, although in the illustrated embodiment, frame portions 6*a* and 6*c* each extend somewhat beyond a plane in which frame portion 6*b* extends, and both lie in a plane that is above that in which frame portions 6*b* and 6*d* extend. It should be understood, however, that the invention is not limited to an upper main frame portion having only the above-described construction. For example, in other embodiments of the invention, the upper main frame portions 6*a*–6*d* may form any other shape (besides substantially rectangular) which is suitable for use in supporting a scaffolding plank in conjunction with a work platform 9.

Referring now to the intermediate frame portion 6*i*, a first, outer surface of that portion 6*i*, at an upper end thereof, is affixed at 40 (FIG. 8) to an inner surface of frame portion 6*c*, at the second end of the frame portion 6*c*, and a second surface of the frame portion 6*i* (adjacent the upper end thereof) facing the outer surface of frame portion 6*b* preferably is welded or otherwise affixed to that outer surface of frame portion 6*b*, adjacent a first end of that frame portion 6*b*. The first, outer surface of the intermediate frame portion 6*i*, adjacent a lower end thereof, preferably also is affixed at 41 to an inner surface of frame portion 6*g*, adjacent a first, lower end of the frame portion 6*g*. Moreover, a portion of the second surface of frame portion 6*i* (adjacent the lower end thereof) facing an outer surface of lower frame portion 6*e* (adjacent a first end of frame portion 6*e*), preferably is welded or otherwise affixed to that outer surface of lower frame portion 6*e*.

Similarly, a first, outer surface of intermediate frame portion 6*h*, at an upper end thereof, is affixed at 42 to an inner surface of frame portion 6*a*, at the second end of frame portion 6*a*, and a second surface of the frame portion 6*h* (adjacent the upper end thereof) facing the outer surface of frame portion 6*b* (adjacent a second end of that frame portion 6*b*) preferably is welded or otherwise affixed to that outer surface of frame portion 6*b*. Also, the first, outer surface of the intermediate frame portion 6*h*, at a lower end thereof, is affixed at 43 to an inner surface of frame portion 6*f*, adjacent a first, lower end of the frame portion 6*f*, and a portion of the second surface of the frame portion 6*h* facing the outer surface of lower frame portion 6*e* (adjacent a second end of frame portion 6*e*), preferably is welded or otherwise affixed to that outer surface of frame portion 6*e*.

Referring now to the front passive support bars 6*k* and 6*j*, in the illustrated embodiment, an outer surface of the support bar 6*k*, adjacent a first, upper end of the bar 6*k*, is affixed at 44 to the inner surface of the frame portion 6*a*, at an intermediate portion of the frame portion 6*a* between the two ends thereof. A second, lower end of the bar 6*k* is disposed adjacent to an upper surface of the base plate 2*a*, but preferably is not fixedly secured to that base plate 2*a*, although in other embodiments, the second, lower end of bar 6*k* may be fixedly secured to the base plate 2*a*. Similarly, an outer surface of the support bar 6*j*, adjacent a first, upper end of the bar 6*j*, is affixed at 45 to the inner surface of the frame portion 6*c*, at an intermediate portion of the frame portion 6*c* between the two ends thereof. A second, lower end of the bar 6*j* is disposed adjacent to an upper surface of the base plate 2*b*, but preferably is not fixedly secured to that base plate 2*a*, although in other embodiments, the second, lower end of bar 6*j* may be fixedly secured to the base plate 2*b*. Also, the inner surface of the intermediate frame portion 6*f*, adjacent a second, upper end thereof, is affixed at 46 to an outer surface of front passive support bar 6*k*, and the inner surface of the intermediate frame portion 6*g*, adjacent a second, upper end thereof, is affixed at 47 (FIG. 1) to an outer surface of front passive support bar 6*j*. Preferably, the front passive support bars 6*k* and 6*j* extend substantially perpendicularly relative to corresponding upper surfaces of the base plates 2*a* and 2*b*, respectively, although there preferably is a predetermined spatial distance (e.g., ⅛") separating the second, lower end of each bar 6*k* and 6*j* and the corresponding base plate 2*a* and 2*b*. Also, the support bar 6*k* and intermediate frame portion 6*f* preferably are oriented so as to collectively form substantially a right angle, the support bar 6*j* and intermediate frame portion 6*g* preferably also are oriented so as to collectively form substantially a right angle, and the frame portions 6*f* and 6*g* preferably extend in a plane that is substantially parallel to an upper surface of base plates 2*a* and 2*b*, respectively. Moreover, the passive support bars 6*k* and 6*j* preferably are orientated relative to the main frame 6 so that support bar 6*k* and frame portion 6*a* collectively form a predetermined angle of, for example, approximately 45 degrees, and the support bar 6*j* and frame portion 6*c* preferably also are orientated so as to collectively form substantially that same angle. The intermediate frame portions 6*f*, 6*g*, 6*h*, 6*i*, lower frame portion 6*e*, and support bars 6*j* and 6*k* function to cause a force applied thereto, and originated from a downward force applied to the work platform 9 (e.g., a force resulting from the weight of a scaffolding plank and/or a worker), to be evenly distributed to the support bars 4*a* and 4*b* (in addition to the force distributed to bars 5*a* and 5*b*) and base plates 2*a* and 2*b*, as will be described in further detail below. The passive support bars 6*j* and 6*k* also function to further stabilize the upper main frame portion when a downward force is applied thereto. For example, in the event that a greater force is applied to one side of the upper main frame portion than to an opposite side thereof (e.g., disposed on an opposite side of the arm 9), the bar 6*j* or 6*k* disposed underneath the side subjected to the greater force stabilizes the upper main frame portion by displacing towards and coming into stabilized contact with the respective base plate 2*b* or 2*a*, as a result of the force applied to the bar 6*j* or 6*k*, and also causes at least a portion of the greater force to be distributed towards the opposite side of the device 11, for preventing or at least substantially reducing any tendency of the device 11 to tilt.

In the example being described, each base plate 2*a* and 2*b* preferably has dimensions of approximately ⅜" (height thickness)×8" (width)×18" (length), and includes aluminum, although in other embodiments, other dimensions and materials may be employed instead. Also, in the preferred embodiment of the invention, each base plate 2*a* and 2*b* has angled corners 27. That configuration reduces the overall area occupied by the base plates 2*a* and 2*b*, and enables the bracket 11 to be conveniently situated adjacent to sharp corners formed by structures on building roof decks.

Figure 7:
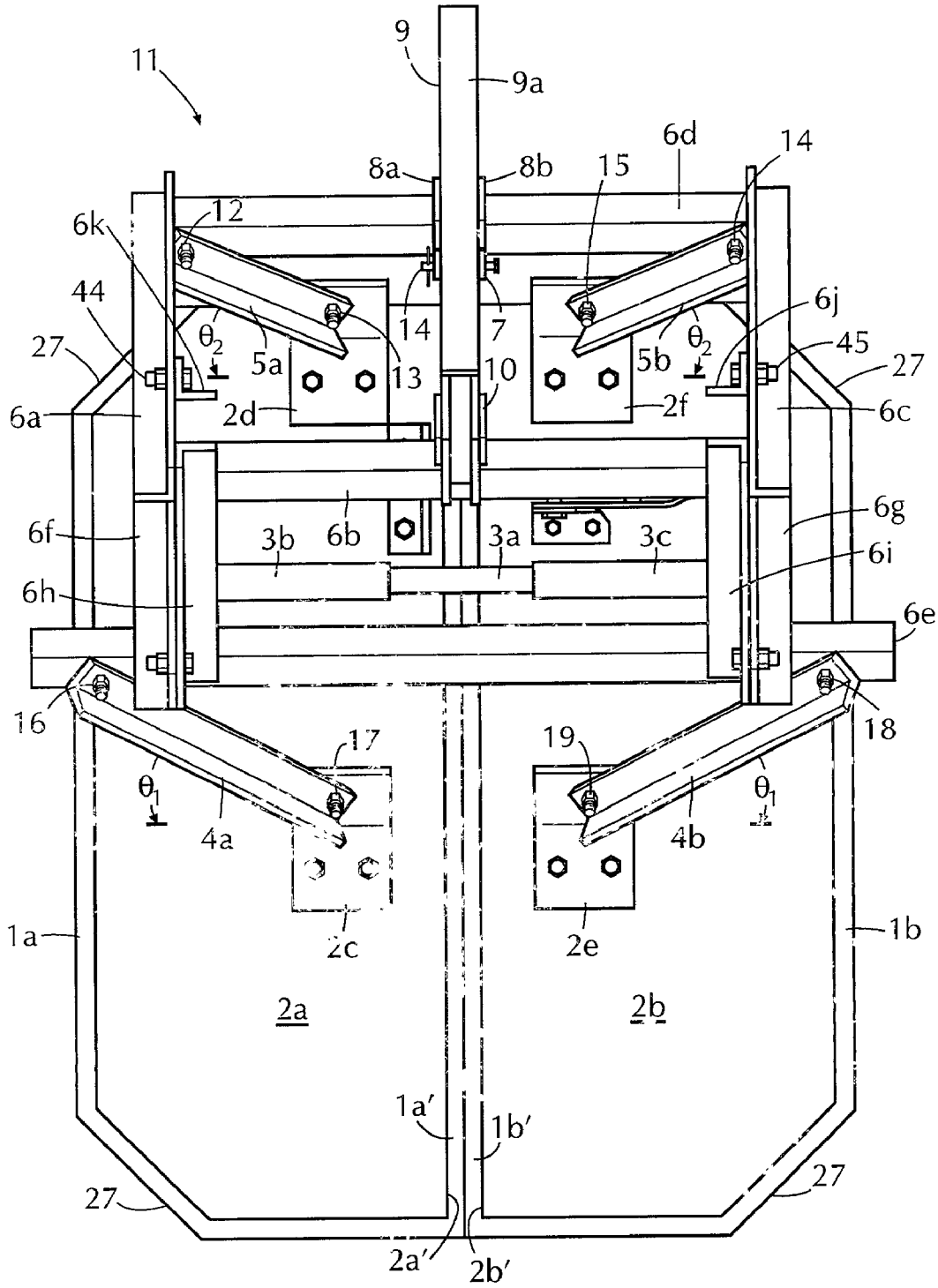
FIGS. 7 and 8 are perspective views of the standing seam roof bracket of FIG. 1.
Figure 8:
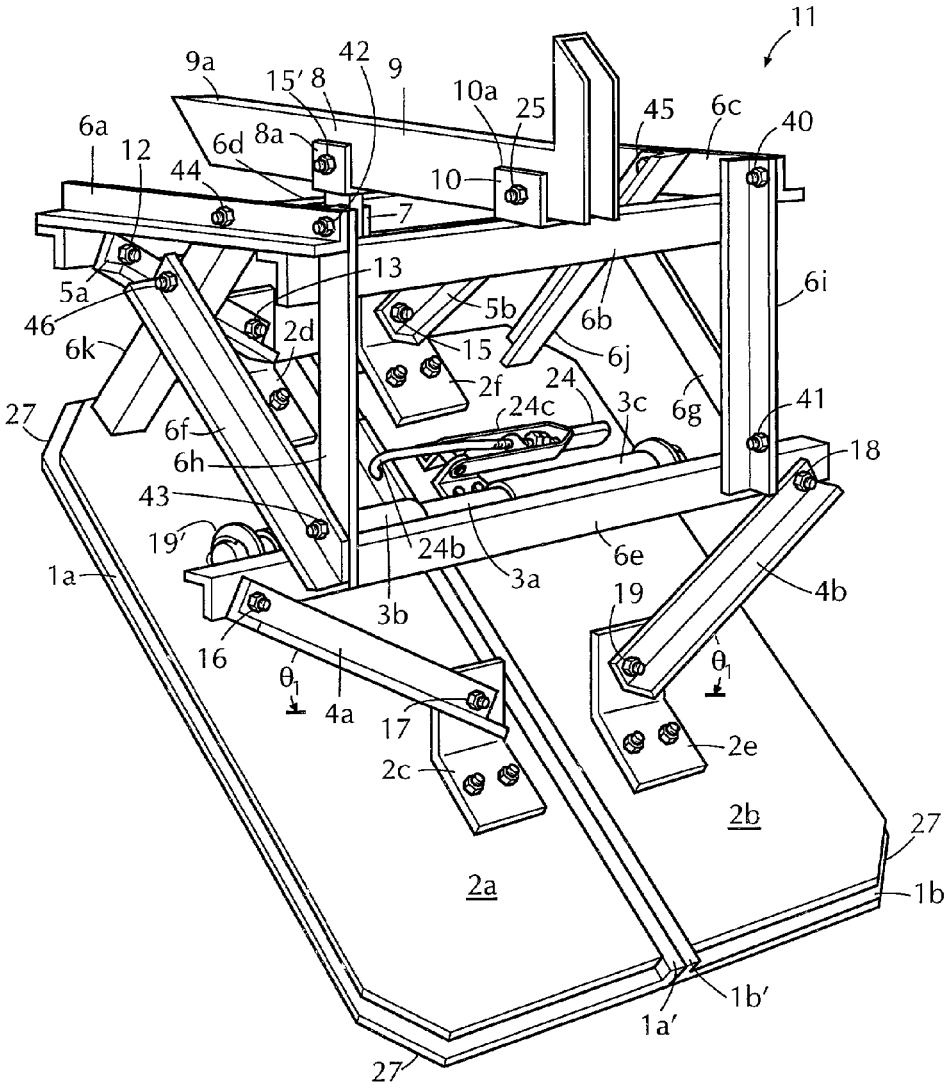

The base plate pad 1*a* is attached at an upper surface thereof to a lower surface of the base plate 2*a*, and the base plate pad 1*b* is attached at an upper surface thereof to a lower surface of the base plate 2*b*. At least a portion of each base plate pad 1*a* and 1*b* (covering the lower surface of the respective plates 2*a* and 2*b*) preferably has a shape and dimensions that are substantially the same as those of the respective plates 2*a* and 2*b*, although the pads 1*a* and 1*b* preferably also include ridge portions 1*a*' and 1*b*', respectively, which are affixed to and cover inner side surfaces 2*a*' and 2*b*', respectively, of the corresponding plates 2*a* and 2*b* (FIG. 7). The pads 1*a* and 1*b* may be attached to the corresponding plates 2*a* and 2*b* by, for example, a contact cement (e.g., splice cement) or some other suitable securing mechanism. Preferably, each pad 1*a* and 1*b* comprises a material such as EPDM rubber or some other suitable material that (a) has a high coefficient of friction making it suitable for tending to prevent the overall 11 bracket from sliding significantly on the surface of a roof (such as roof 20), and (b) is non-abrasive, in order to prevent the bracket 11 from scratching or otherwise physically damaging the roof 20 when arranged thereon. In one embodiment of the invention, a lower surface of each base plate pad 1*a* and 1*b* also is ribbed to even further ensure the stable positioning of the bracket 11 on roof 20, although for convenience this is not represented in the drawings.

In the example being described, the support gussets 2*c*–2*f* are each angled or curved rectangular plates, and are formed by two 2"×2" plates that are welded or otherwise affixed together to collectively form a curved or angled plate, although in other embodiments, the support gussets may have other shapes and dimensions and may be formed by a single integral, angled plate. A lower surface of a first portion of each of the support gusset 2*c* and 2*d* preferably is welded or otherwise affixed to an upper surface of the base plate 2*a*, and each gusset 2*c* and 2*d* preferably is shaped so that its upper, angled (second) portion extends from its lower, non-angled (first) portion at a predetermined angle θ relative to the base plate 2*a*. Similarly, a lower surface of each support gusset 2*e* and 2*f* preferably is welded or otherwise affixed to an upper surface of base plate 2*b*, and each support gusset 2*e* and 2*f* preferably is shaped so that its upper, angled (second) portion extends from its lower, non-angled (first) portion at a predetermined angle θ relative to the base plate 2*b* (see FIG. 1). For example, the angle θ may be 45 degrees or any other suitable angle, depending on the applicable roof pitch (e.g., an angle θ of 45 degrees is well-suited for roofs having a pitch as steep as approximately a 45 degree slope). In the illustrated embodiment, the support gussets 2*c*–2*f* are shown as being affixed to the corresponding base plate 2*a* or 2*b* through a nut and bolt assembly, although it should be noted that any other suitable type of securing mechanism may be employed instead.

Figure 4:
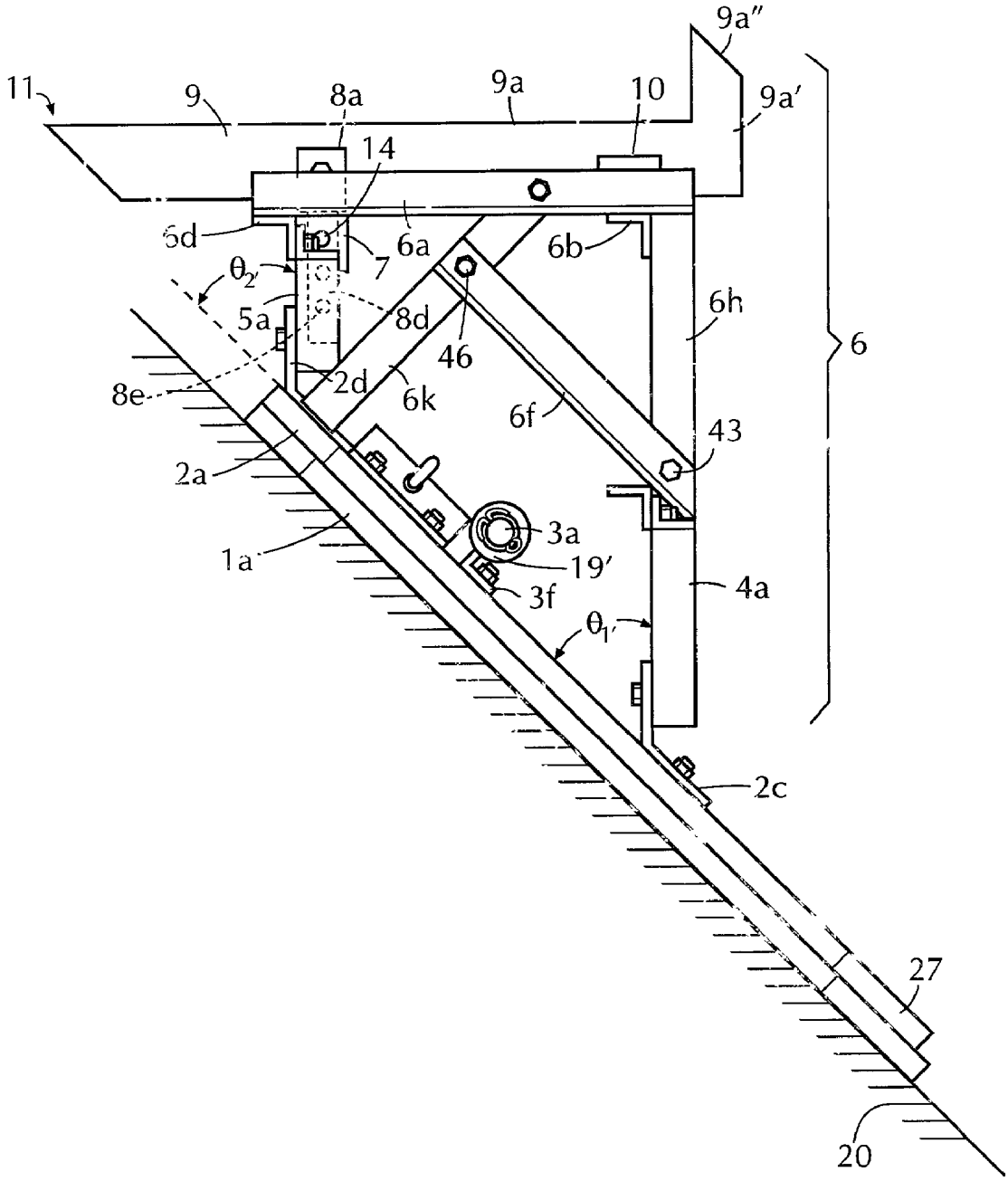
FIG. 4 shows the standing seam roof bracket of FIG. 1 disposed on the roof 20 of that figure, as viewed from a perspective looking towards a side opposite to that shown in FIG. 1.
Figure 5:
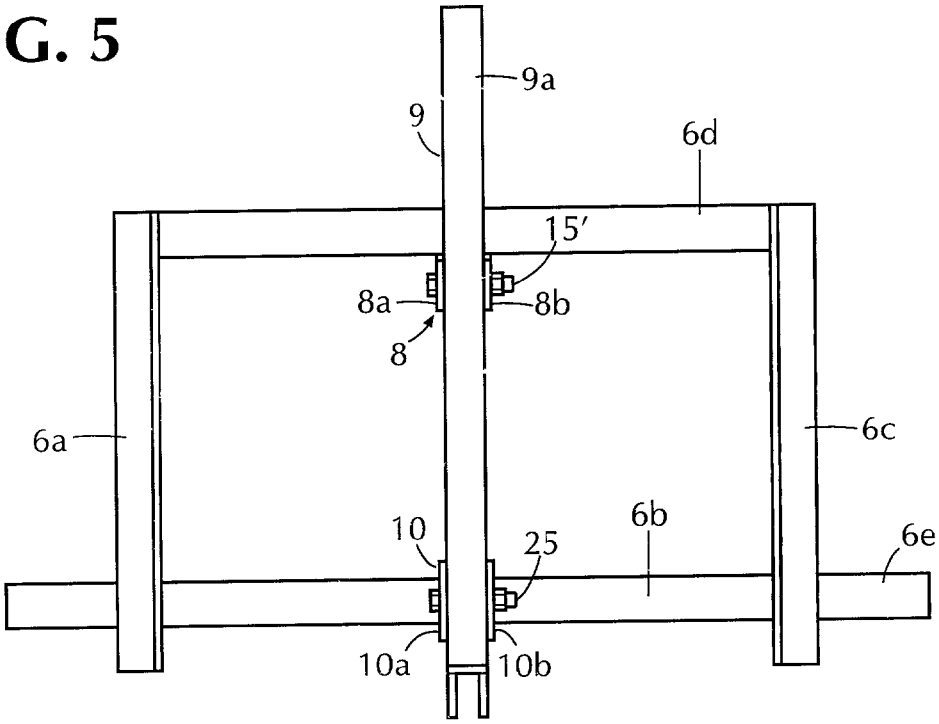
FIG. 5 shows the standing seam roof bracket of FIG. 1, with all components of the bracket removed except for a platform support member and a portion of a lower frame portion 6*e*, as viewed from a perspective looking down on the bracket.
Figure 6:
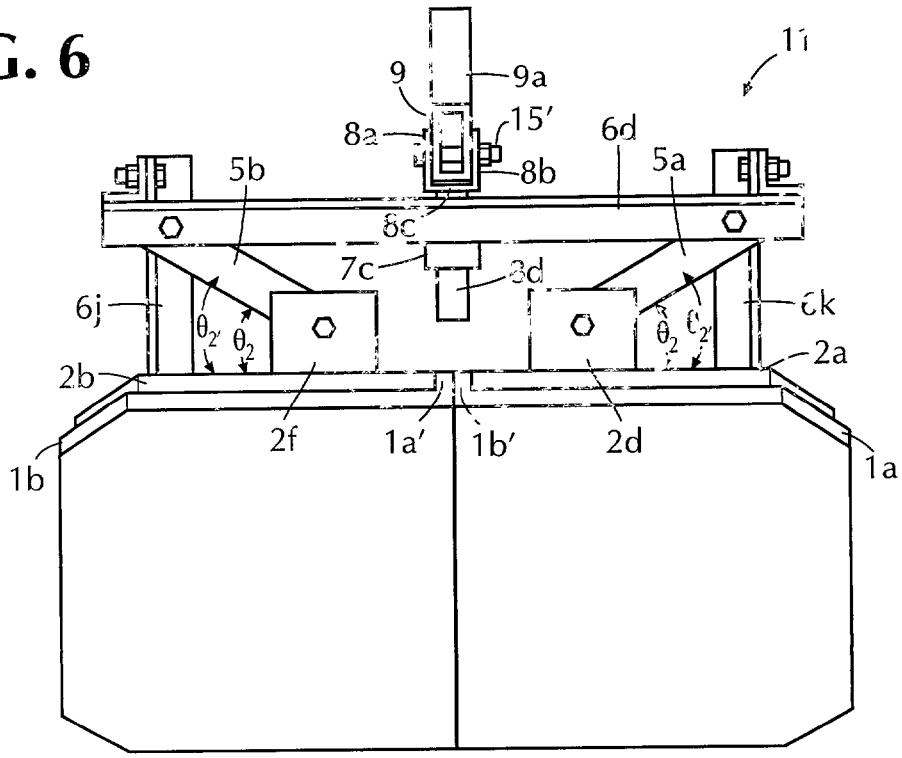
FIG. 6 shows the standing seam roof bracket of FIG. 1, with all components removed except for those shown in FIG. 6, as viewed from a perspective looking towards a front of the bracket.

Referring to FIGS. 5 and 6–8, the front active support bars 5*a* and 5*b* attach the main frame 6 to the base plates 2*a* and 2*b*, respectively, through the respective gussets 2*d* and 2*f*, and the rear active support bars 4*a* and 4*b* attach the main frame 6 to the base plates 2*a* and 2*b*, through the gussets 2*c* and 2*e*, respectively. More particularly, an upper end of front active support bar 5*a* is pivoted at 12 to an inner facing surface of frame portion 6*d*, adjacent the first end of the frame portion 6*d*, and a lower end of the front active support bar 5*a* is pivoted at 13 to an inner facing surface of support gusset 2*d* (FIG. 7). Similarly, an upper end of front active support bar 5*b* is pivoted at 14 to an inner facing surface of the frame portion 6*d*, adjacent the second, opposite end of the frame portion 6*d*, and a lower end of front active support bar 5*b* is pivoted at 15 to an inner facing surface of support gusset 2*f* (FIG. 7). Moreover, an upper end of rear active support bar 4*a*, which, in the illustrated embodiment, is longer than the front active support bar 5*a*, is pivoted at 16 to the outer surface of lower frame portion 6*e*, adjacent the second end of that lower frame portion 6*e*, and a lower end of support bar 4*a* is pivoted at 17 to support gusset 2*c*. Similarly, an upper end of rear active support bar 4*b* is pivoted at 18 outer surface of lower frame portion 6*e*, adjacent the first end of that lower frame portion 6*e*, and a lower end of the support bar 4*b* is pivoted at 19 to support gusset 2*e*. The pivots 12–19 preferably are provided by a nut and bolt (e.g., screw) assembly, although in other embodiments, other suitable securing and pivoting mechanisms may be employed instead. Preferably, during times when no downward force is being applied to the work platform 9, the support bars 4*a* and 4*b* are orientated so that a plane in which a lower surface of each bar 4*a* and 4*b* extends forms an angle θ1 (in a plane normal to that lower surface) relative to an upper surface of the corresponding base plate 2*a* or 2*b*, respectively (FIGS. 2, 7, and 8), and so that a plane in which a side surface of each bar 4*a* and 4*b* extends forms an angle θ1' (in a plane normal to that side surface) relative to an upper surface of the corresponding base plate 2*a* or 2*b*, respectively (FIGS. 1 and 4). Also during times when no downward force is being applied to the work platform 9, the support bars 5*a* and 5*b* preferably are orientated so that a plane in which a lower surface of each bar 5*a* and 5*b* extends forms an angle θ2 (in a plane normal to that lower surface) relative to an upper surface of the corresponding base plate 2*a* or 2*b*, respectively (FIGS. 6 and 7), and so that a plane in which a side surface of each bar 5*a* and 5*b* extends forms an angle θ2' (in a plane normal to that side surface) relative to an upper surface of the corresponding base plate 2*a* or 2*b*, respectively (FIGS. 1, 4, and 6). For example, the angles θ1 and θ2 each may be 30 degrees, and the angles θ1' and θ2' each may be 45 degrees, although in other embodiments, other suitable angles may be employed instead, depending on applicable operating criteria.

The work platform 9 (also referred to herein as a "platform support arm") preferably has a square or rectangular cross section, and has an upper surface 9*a* that is employed for supporting one or more scaffolding planks 21 (see, e.g., FIG. 9) for supporting a worker 23. The work platform 9 may be, for example, tubular, although in other embodiments the platform 9 may have a solid cross section. As can be seen in FIG. 1, the work platform 9 preferably has a first end surface 9*b* that is disposed at a predetermined angle relative to a lower surface 9*c* of the platform 9, so that the platform 9 can extend to or substantially close to a pitched standing seam roof, such as the roof 20. In a preferred embodiment of the invention, a lip portion 9*a*' comprised of aluminum or some other suitable material is welded or otherwise secured to the upper surface 9*a* of the work platform 9, adjacent to a second end of the platform 9 opposing the first end surface 9*b* (see, e.g., FIG. 1), although in other embodiments, the lip portion 9*a*' may be an integral part of the overall work platform 9. The lip portion 9*a*' preferably extends from the upper surface 9*a* by a distance that is long enough for preventing a scaffolding plank (not shown in FIG. 1) supported on the surface 9*a* from sliding off the platform 9, and, in a preferred embodiment, has an angled end 9*a*" to reduce the possibility that items besides scaffolding planks will undesirably become engaged by the lip portion 9*a*'. Also, although not shown in the drawings, the lip portion 9*a*' may also include an aperture through at least one surface thereof, for receiving at least one nail, screw or other suitable securing mechanism therein, to enable the securing mechanism to further secure the scaffolding plank (s) 21 to the platform 9 (e.g., for enabling a nail to be driven into the plank(s) 21).

The rear pivot assembly 10 will now be described. The assembly 10 includes a channel-shaped arm support member (e.g., a "C" channel) that comprises a base 10*c* (FIG. 2) from which extends two opposing ears 10*a* and 10*b* (see also FIG. 5) having aligned apertures therethrough and being positionable on opposite sides of the work platform 9. A lower surface of the base 10*c* is welded or otherwise affixed to the upper facing surface of frame portion 6*b*, and preferably is centered substantially midway between the two opposing ends of the frame portion 6*b*. The apertures of the ears 10*a* and 10*b* are aligned with apertures (not shown) provided through opposing walls of the platform 9 for the reception of, for example, a screw, bolt, or pin 25 therethrough, to enable the element 25 to pivotally secure the platform 9 to the ears 10 and 10*b* of the arm support member. In this manner, the platform 9 can be rotated about the element 25 so as to be placed in a desired inclination relative to the main frame 6 (e.g., frame portion 6*b*), as will be described further below.

The front adjustment rod and pivot assembly 8 will now be described. Referring to FIG. 6, the assembly 8 includes a channel-shaped arm support member (e.g., a "C" channel) that comprises a base 8*c* from which extends two opposing ears 8*a* and 8*b* having aligned apertures (not shown) therethrough and being positionable on opposite sides of the work platform 9, and an elongated rod 8*d* which extends downward from a lower surface of the base 8*c*. The apertures of the ears 8*a* and 8*b* are aligned with apertures (not shown) provided through opposing walls of the platform 9 for the reception of a screw, bolt, or pin 15' (FIG. 5) therethrough, to enable the bolt 15' to secure the platform 9 to the ears 8*a* and 8*b* of the arm support member. The rod 8*d* includes, for example, aluminum tubing, and preferably has opposing walls that are provided with plural sets of aligned apertures or holes 8*e* (FIGS. 4 and 10) therethrough, although in other embodiments, the rod 8*d* may have a solid cross section with plural through-holes provided therein, and may include other materials besides aluminum.

The assembly 8 also comprises a rear adjustment sleeve 7 (e.g., a "C" channel) that includes a base portion 7*c* (FIG. 6) which is welded or otherwise affixed to an inner facing surface of the frame portion 6*d* of main frame 6, and which preferably is disposed so that the overall sleeve 7 is substantially centered on that inner facing surface of frame portion 6*d*, as can be appreciated in view of FIG. 10. The sleeve 7 also comprises two opposing walls 7*a* and 7*b* (FIG. 10) extending from opposite ends of the base portion 7*c*, and which have aligned apertures therethrough and are positionable on opposite sides of the rod 8*d*. The components 7*a*–7*c* of the rear adjustment sleeve 7 preferably at least partially surround an internal channel area that is large enough to receive a cross section of the rod 8*d*.

The rod 8*d* preferably has a square cross section of a size that is suitable for enabling that cross section to be received within the internal channel area between the components 7*a*–7*c* of the sleeve 7. When the rod 8*d* is received within that area, and opposing holes 8*e* of the rod 8*d* are aligned with the opposing holes in the walls 7*a* and 7*b* of the sleeve 7, a bolt or pin 14' can be inserted through those holes to secure the rod 8*d* in the sleeve 7. Moreover, a clip pin 14" preferably is inserted in a through-hole in the pin 14', to prevent the pin 14' from backing out of the holes in the sleeve 7 and rod 8*d*.

As can be appreciated by one skilled in the art in view of this description, the plural sets of apertures 8*e* in the rod 8*d* enable the orientation of the work platform 9 to be adjusted so as to be placed at a desired inclination relative to the main frame 6, and thereby enable the platform 9 to be properly positioned for supporting scaffolding planks on roof decks having a wide range of pitches. It should be recognized that the adjustability of the platform 9 is not limited to any predetermined angles or series of angles, but rather can be adjusted at any conceivable angle between the extremes thereof. This capability ensures the appropriate positioning of scaffolding planks, regardless of the roof pitch, and thereby ensures worker safety.

The manner in which the bracket 11 operates in response to a downward force being applied to the upper surface 9*a* of the work platform 9 will now be described. When a downward force is applied to the work platform 9 (resulting from, for example, the weight of scaffolding plank(s) and/or a worker), the force is distributed through the platform 9 and components 8 and 10 to the upper portion of the main frame 6, which thereafter distributes the applied forces substantially evenly through the active support bars 5*a* and 5*b*, and through the passive support bars 6*k* and 6*j*, and also substantially evenly through intermediate frame portions 6*f* and 6*g* and intermediate frame portions 6*h* and 6*i*, to the lower frame portion 6*e*, and then evenly from there to support bars 4*a* and 4*b*. The support bars 4*a* and 5*a* then each transmit the force applied thereto through the bar to the base plate 2*a* through the support gussets 2*c* and 2*d*, respectively, and the support bars 4*b* and 5*b* each transmit the force applied thereto through the bar to the base plate 2*b*, through the support gussets 2*e* and 2*f*, respectively. Owing to the orientation of each support bar 4*a* and 5*a* relative to the base plate 2*a*, and the orientation of each support bar 4*b* and 5*b* relative to the base plate 2*b*, the forces are applied to the base plate 2*a* and 2*b* in a direction which causes those plates to exert a downward force on the roof 20 (through the base plate pads 1*a* and 1*b*), and to cause the base plates 2*a* and 2*b* to relatively displace towards one another and the standing seam 22. As a result, the ridge portions 1*a*' and 1*b*' of the pads 1*a* and 1*b*, respectively, are drawn towards each other and crimp or clamp the standing seam 22, thereby lockingly engaging the overall bracket 11 to the seam 22 and preventing any tendency of the bracket 11 to slide along the surface of the roof 20. It can therefore be appreciated that any increase in the superimposed load or any vibration such as might occur when a worker 23 walks on planks 21 supported by the work platform 9 will only tend to tighten that locking engagement.

Figure 9:
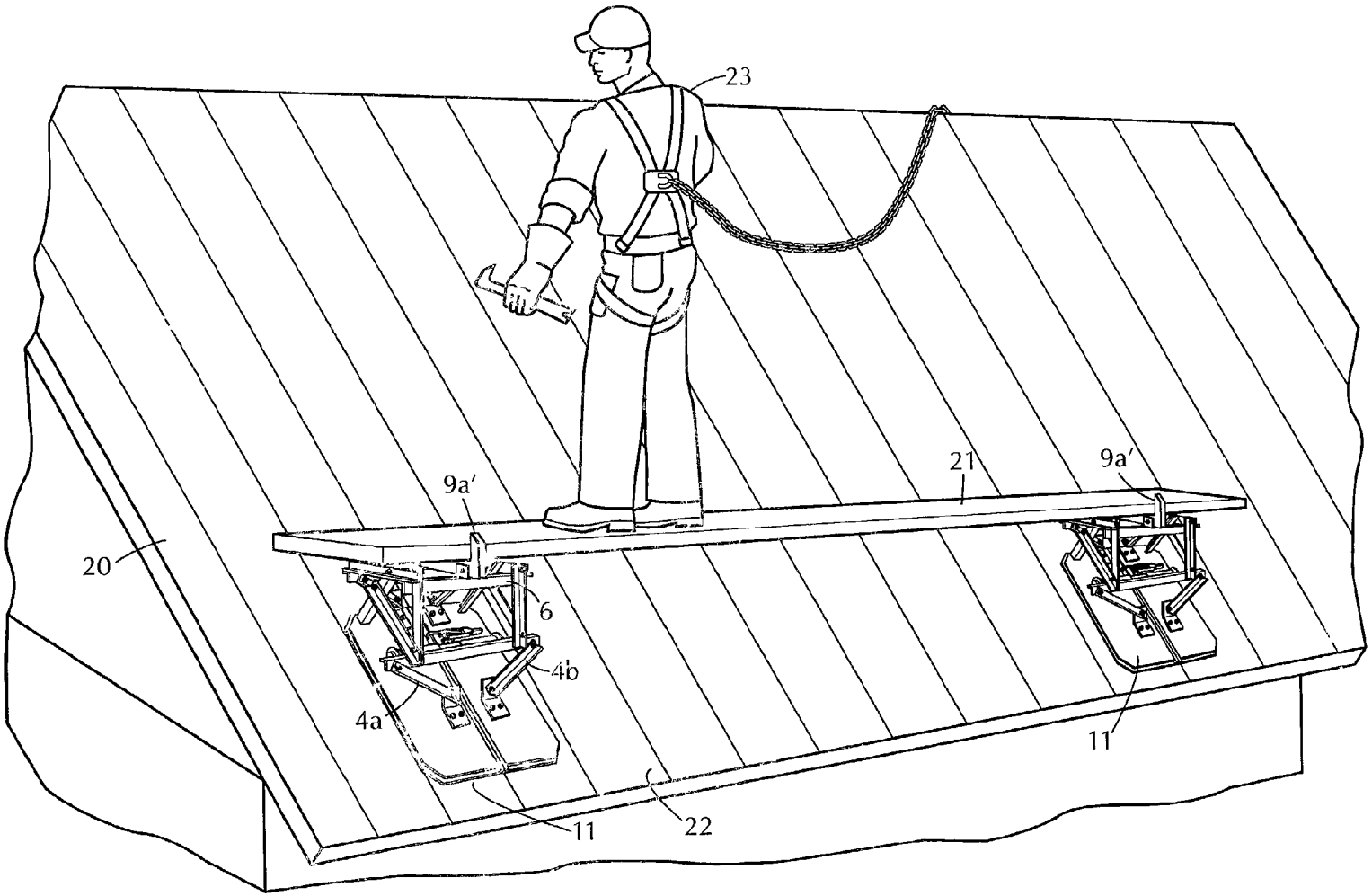
FIG. 9 shows the manner in which a plurality of standing seam roof brackets according to this invention are employed to support scaffolding and a worker on a standing seam roof deck.

FIG. 9 shows the manner in which a plurality of the standing seam roof brackets 11 according to this invention support one or more scaffolding planks 21 and a worker 23 on the standing seam roof 20. Although two brackets 11 are shown in FIG. 9, it should be noted that more or less than that number of brackets 11 may be employed to support one or more scaffolding planks and/or workers, depending on, for example, the particular application and roof configuration of interest.

The rod and lock assembly 3 will now be described. In a preferred embodiment of the invention, the rod and lock assembly 3 is provided to even further ensure and tighten the locking engagement of the bracket 11 to the roof seam 22. Referring to FIGS. 2, 3, 7, and 8, the assembly 3 preferably comprises an elongated shaft or rod-like member 3*a*, tube portions 3*b* and 3*c* which each have a hollow internal channel therethrough, support plates 3*e* and 3*f*, which, in the illustrated embodiment, are angled plates (e.g., 90 degrees), and a clip pin and washer assembly 19'. The support plates 3*e* and 3*f* are attached to the upper surface of the respective base plates 2*b* and 2*a* through a nut and bolt assembly, welding, or some other suitable attachment mechanism, the tube portions 3*c* and 3*b* are welded or otherwise attached to an upper surface of an upper facing portion of the support plates 3*e* and 3*f*, respectively, and the hollow channel through the tube portion 3*b* is aligned with that of tube portion 3*c*. Preferably, the support plates 3*e* and 3*f* each have a same height that is larger than that of the standing seam 22.

The tube portions 3*b* and 3*c* and rod-like member 3*a* preferably have similar cross-sections that may be, for example, circular, rectangular, or another suitable shape, although the tube portions 3*b* and 3*c* are slightly wider in cross-section than the rod-like member 3*a* so that the rod-like member 3*a* can be received in the channels of those tube portions 3*b* and 3*c*. The clip pin and washer assembly 19' secures the rod-like member 3*a* in place at opposite ends of the member 3*a*, wherein in the illustrated embodiment, through-holes are provided at those ends for receiving an arm of a clip pin of assembly 19' therein, for securing the position of the member 3*a* between washers of the assembly 19'.

In accordance with one embodiment of this invention, another mechanism may be provided, either in addition to, or in lieu of the assembly 3, to even further ensure and tighten the locking engagement of the bracket 11 to the roof seam 22. For example, a latch lock mechanism 24 (FIGS. 3, 4, and 8) such as a stainless steel latch clamp available from Grainger, Carrlane item Model No. CL-250-PA-S, may be employed, and may be secured to the base plates 2*a* and 2*b* as shown. When a handle 24*c* of the mechanism 24 is in a downward or closed position, a hook member 24*b*, which is attached at one end to the handle 24*c* and hooked at another end to a gusset 24*a* (e.g., an angled aluminum bar) through a hole in gusset 24*a*, pull the gusset 24*a* towards the hook member 24*b*. As a result, since the gusset 24*a* and handle 24*c* are secured to the base plates 2*a* and 2*b*, respectively, the base plates 2*a* and 2*b* and base plate pads 1*a* and 1*b* are drawn towards one another to further clamp the seam 22. In this manner, the assembly can be used to lockingly engage the bracket 11 with the seam 22, if not engaged already, or to further tighten the locking engagement of the bracket 11 to the standing seam 22, if engaged already. This capability further ensures that the bracket 11 does not become disengaged with the seam 11, especially in the event that a downward force applied to the work platform 9 is removed. As shown in the illustrated embodiment, the hook member 24*b* preferably includes a threaded portion that is engaged with threads provided in the handle 24*c*, to enable the position of the hook member 24*b* and the relative displacement of the base plate 2*a* and 2*b* and base plate pads 1*a* and 1*b* to be adjusted.

In another embodiment of the invention, a threaded shaft (not shown) is employed instead of the rod-like member 3*a*, and inner surface areas of the tube portions 3*b* and 3*c* also are threaded, for enabling the shaft to be adjusted for causing the relative displacement of the base plates 2*a* and 2*b* and base plate pads 1*a* and 1*b*. In accordance with further embodiment of this invention, the assembly 3 may be implemented with a cam mechanism (not shown) disposed at a first end of rod-like member 3*a* and a nut and washer assembly disposed at the second end of the rod-like member 3*a*. For example, the cam may be pivoted at the first end of the rod-like member 3*a*, and when pivoted to a position where a projecting or lobe portion of the cam tightly engages with the tube portion 3*b*, the tube portions 3*b* and 3*c* are caused to be drawn towards one another by the rod-like member 3*a* and nut and washer assembly. As a result, the base plates 2*a* and 2*b* and pads 1*a* and 1*b* also are drawn towards one another to clamp the seam 22 (if not already clamped). Although the cam is not represented in the drawings, one skilled in the art would clearly appreciate in view of this description the manner in which the cam would be pivoted to the rod-like member 3*a* and operated to ensure the locking engagement of the bracket 11 to the standing seam 22.

It should be noted that, although this description is described in the context of the bracket 11 comprising, among other things, either a rod-like member 3*a*, threaded shaft, or cam mechanism, and/or a latch lock mechanism 24, it also is within the scope of this invention to employ any other suitable type of assembly, in addition to, or in lieu of, those components, to further enable the bracket 11 to be lockingly engaged to the roof seam 22. Alternatively, only one of the assembly 3 or mechanism 24 may be employed, or, in other embodiments, no such assembly 3 or mechanism need be employed at all. In this case, the bracket 11 secures to the roof seam 22 simply by means of the downward force applied to the work platform 9, in the above-described manner. It should therefore be appreciated in view of this description that the assembly 3 and mechanism 24 function to even further ensure and tighten the locking engagement of the bracket 11 to the roof seam 22, when the bracket 11 is already clamped to the roof seam 22 as a result of a downward force applied to the work platform 9, or to provide such an engagement when no such downward force is being applied to the work platform 9.

It also is within the scope of this invention to provide other configurations of the bracket 11 besides the configuration described herein and shown in the drawings, so long as the bracket enables a downward applied force to be directionally distributed in a manner which enables the base plates 2*a* and 2*b* and base plate pads 1*a* and 1*b* to be drawn together for clamping the standing seam 22 of a roof 20. For example, in another embodiment of this invention, the bracket 11 may be comprised of main frame that includes only upper main frame portions 6*a*–6*d*, and the support bars 4*a*, 5*a*, and 4*b*, 5*b* in that embodiment are pivotally attached to the main frame and corresponding base plates 2*a* and 2*b* (i.e., no intermediate frame portions 6*f*, 6*g*, 6*h*, and 6*i*, lower frame portion 6*e*, and/or passive support bars 6*j* and 6*k*, need be employed), although this specific configuration is not explicitly shown in the drawings. In this embodiment, the support bars 4*a*, 4*b*, 5*a*, and 5*b* preferably also have an orientation which enables a downward applied force to the main frame to be directionally distributed to the base plates 2*a* and 2*b* in a manner which causes the bracket 11 to clamp the roof seam 22, in a similar manner as described above.

In still another embodiment of the invention, the supports bars 4*a*, 4*b*, 5*a*, and 5*b* need not be orientated in a manner which enables a downward applied force to be distributed so as to cause the base plates 2*a* and 2*b* (and pads 1*a* and 1*b*) to clamp the standing seam 22, and the clamping of the bracket 11 to the seam 20 may be provided instead by the assembly 3 and/or latch lock mechanism 24.

Also, in other embodiments the work platform 9 need not be adjustable, and may be non-pivotally attached to main frame 6 so as to be arranged in a permanent orientation. In still a further embodiment (not shown) of the invention, the bracket 11 may have a configuration in which the work platform 9 is pivotally secured at one end to, and rotatable at least partially around, the front portion (e.g., frame portion 6*d*) of the main frame 6, and the adjustment rod and pivot assembly 8 may be provided at the rear portion (e.g., frame portion 6*b*) of the main frame 6 (i.e., in this embodiment, the portion of the work platform 9 adjacent the frame portion 6*b* is secured to the rod 8*d* of assembly 8). As for the above-described embodiment, the present configuration also enables the inclination of the work platform 9 to be adjusted as desired, but in this case relative to the front portion of the main frame 6, and also enables the platform 9 to be positioned appropriately for supporting scaffolding planks on roof decks having a wide range of pitches.

Moreover, while the invention has been described in the context of the bracket 11 having a configuration making it suitable for use with standing seams that extend from an upper roof ridge to a lower roof edge, broadly construed, the invention is not so limited. For example, it also is within the scope of this invention for the bracket 11 to have a configuration that is suitable for securing to standing seams that extend along roofs in a parallel relationship to the upper roof ridge, or along some other direction, depending on the type of standing seam roof employed.

Furthermore, although the invention is described in the context of certain components of the bracket 11 being welded together, it should be noted that any other suitable types of securing mechanisms may be employed instead or in lieu thereof. For example, preferably such components are secured together through a rivet and a welding.

While the invention has been particularly shown and described with respect to preferred embodiments thereof, it will be understood by those skilled in the art that changes in form and details may be made therein without departing from the scope and spirit of the invention. For example, many of the dimensions and materials discussed above may be changed without departing from the scope and spirit of the invention. Other modifications may be made as well.

What is claimed is:

1. A roof attachment apparatus for being arranged on a roof having at least one standing seam, comprising:

a plurality of base plates for being disposed on opposite sides of the standing seam on a surface of the roof;

a platform support member; and a plurality of support bars orientated to enable a force applied to said platform support member and distributed through said support bars, to be applied to said base plates for causing those base plates to displace towards one another and clamp the standing seam, wherein said platform support member comprises:

a main frame, an elongated platform support arm pivotally secured adjacent a first end thereof to a rear portion of said main frame, and being rotatable about at least part of that rear portion, an elongated support member having an end secured adjacent a second end of said platform support arm, and a fastener for securing a selected portion of said elongated support member, to a front portion of said main frame opposing the rear portion, for enabling said platform support arm to be fixedly inclined at a selected angle relative to the rear portion of said main frame, wherein said main frame comprises an upper main frame portion having a predetermined shape, an intermediate main frame portion, and a lower main frame portion, wherein said intermediate main frame portion is fixedly coupled to said upper and lower main frame portions and is orientated so as to fixedly support at least part of said upper main frame portion, and wherein at least a first one of said support bars is pivotally coupled at a first end thereof to the front portion of said upper main frame portion and at a second end thereof to a first one of said base plates, at least a second one of said support bars is pivotally coupled at a first end thereof to the front portion of said upper main frame portion and at a second end thereof to a second one of said base plates, at least a third one of said support bars is pivotally coupled at a first end thereof to said lower main frame portion and at a second end thereof to the first one of said base plates, and at least a fourth one of said support bars is pivotally coupled at a first end thereof to said lower main frame portion and at a second end thereof to the second one of said base plates.

2. A roof attachment apparatus as set forth in claim 1, wherein each of said first and third support bars is disposed along a respective axis that forms at least one angle relative to an upper surface of said first base plate, and each of said second and fourth support bars is disposed along a respective axis that forms at least one angle relative to an upper surface of said second base plate.

3. A roof attachment apparatus as set forth in claim 1, further comprising a plurality of elongated passive support bars orientated so as to further support said main frame from said base plates, during at least a portion of a time when the force is applied to said platform support member.

4. A roof attachment apparatus as set forth in claim 1, further comprising a plurality of base plate pads, each base plate pad covering at least a portion of an outer surface of a respective one of said base plates.

5. A roof attachment apparatus as set forth in claim 4, wherein said base plate pads each comprise a rubber material.

6. A roof attachment apparatus as set forth in claim 1, further comprising a clamping mechanism coupled to said base plates, and arranged for maintaining said base plates in a selected relative displacement.

7. A roof attachment apparatus for being arranged on a roof having at least one standing seam, comprising:

a first base plate for being disposed on a surface of the roof;

a second base plate for being disposed on the surface of the roof, on an opposite side of the standing seam from where the first base plate is disposed;

a platform support member; and a plurality of first support bars, each having a first end pivotally secured to said platform support member and a second end pivotally secured to said first base plate; and a plurality of second support bars, each having a first end pivotally secured to said platform support member and a second end pivotally secured to said second base plate, wherein said first and second support bars transfer a force applied to said platform support member to said first and second base plates, respectively, for causing those base plates to displace towards one another and clamp the standing seam, and wherein said platform support member comprises:

a main frame, an elongated platform support arm pivotally secured adjacent a first end thereof to a first portion of said main frame, and being rotatable about at least part of that first portion, an elongated support member having an end secured adjacent a second end of said platform support arm, and a fastener for securing a selected portion of said elongated support member, to a second portion of said main frame opposing the first portion, for enabling said platform support arm to be fixedly inclined at a selected angle relative to the first portion of said main frame.

8. A roof attachment apparatus as set forth in claim 7, wherein each of said first support bars is disposed along a respective axis that forms at least one angle relative to an upper surface of said first base plate, each of said second support bars is disposed along a respective axis that forms at least one angle relative to an upper surface of said second base plate, and each of said first and second base plates is disposed in a plane that forms an angle relative to an upper surface of said main frame.

9. A roof attachment apparatus as set forth in claim 7, further comprising a lip portion extending from an upper surface of said platform support arm adjacent the second end of said platform support arm.

10. A roof attachment apparatus as set forth in claim 7, further comprising a plurality of base plate pads, each base plate pad covering at least a portion of an outer surface of a respective one of said first and second base plates.

11. A roof attachment apparatus as set forth in claim 10, wherein said base plate pads each comprise a rubber material.

12. A roof attachment apparatus as set forth in claim 7, further comprising a clamping mechanism coupled to said first and second base plates, and arranged for maintaining said first and second base plates in a selected relative displacement.

13. A roof attachment apparatus as set forth in claim 7, further comprising a plurality of elongated passive support bars orientated so as to further support said main frame from said first and second base plates, during at least a portion of a time when the force is applied to said platform support member.

* * * * *